US006397392B1

(12) United States Patent
Wooley et al.

(10) Patent No.: US 6,397,392 B1
(45) Date of Patent: Jun. 4, 2002

(54) POCKETED COMBINATION VEST BACKPACK

(76) Inventors: Christen Diana Wooley; Michael Scott Wooley; Cheryl Lynn Wooley, all of 9051 145th Dr., Live Oak, FL (US) 32060

( * ) Notice: Subject to any disclaimer, the term of this patent is extended or adjusted under 35 U.S.C. 154(b) by 0 days.

(21) Appl. No.: 09/963,937

(22) Filed: Sep. 26, 2001

Related U.S. Application Data

(63) Continuation-in-part of application No. 09/518,746, filed on Mar. 3, 2000, now abandoned.
(60) Provisional application No. 60/123,913, filed on Mar. 12, 1999.

(51) Int. Cl.[7] ..... A41D 1/04
(52) U.S. Cl. ..... 2/102; 2/94; 2/247
(58) Field of Search ..... 2/94, 102, 46, 2/69, 85, 93, 2.5, 108, 247, 250–253

(56) References Cited

U.S. PATENT DOCUMENTS 4,658,442 A * 4/1987 Tomlinson et al. ..... 2/102
5,465,425 A * 11/1995 Crispin ..... 2/102
5,617,582 A * 4/1997 Burwell ..... 2/102
5,829,060 A * 11/1998 Falk et al. ..... 2/102
5,909,802 A * 6/1999 Puco et al. ..... 2/102
5,913,409 A * 6/1999 Test ..... 2/102

* cited by examiner

*Primary Examiner*—John J. Calvert
*Assistant Examiner*—Tejash Patel

(57) ABSTRACT

A pocketed vest or a combination vest and backpack garment for carrying school books, notebooks and other loads in a distributed manner such that the weight of the total load is relatively evenly proportioned relative to the front and back of the wearer, where the vest comprises a back body member joined to a pair of front body members, the front body members being releasably connectable, such that the combination of the back and front body members define a pair of arm openings, a neck opening and a waist opening. A relatively large volume rear pocket or compartment is mounted onto the back body member and a relatively large volume front pocket is mounted onto each of the front body members, with the front pockets occupying the majority portion of the front body members. The rear pocket has top, bottom and side panels such that the pocket has a three-dimensional interior. The combined volume of the front pockets is preferably substantially equal to the volume of the rear pocket, and all pockets have large openings to allow large items to be received therein.

19 Claims, 2 Drawing Sheets

POCKETED COMBINATION VEST BACKPACK

This application claims the benefit of U.S. Provisional Application No. 60/123,913, filed Mar. 12, 1999 and is a continuation-in-part of U.S. patent application Ser. No. 09/518,746, filed on Mar. 3, 2000 now abandoned.

BACKGROUND OF THE INVENTION

This invention relates generally to the field of backpacks and pocketed vests worn by people and used for carrying discrete items without the need to use the hands to carry the items, and in particular for bulky or relatively heavy items. More particularly, the invention relates to such devices which comprise a vest structure with a relatively large and voluminous pocket on the rear of the vest. Even more particularly, the invention relates to such devices with additional large pockets on the front of the vest, whereby the overall load can be more evenly distributed between the front and the rear of the wearer, which is especially applicable to children required to transport large, heavy books and notebooks back and forth to school.

It is very common for schoolchildren to have different books covering different subjects, along with one or more notebooks which must be carried home and back to school. These books and notebooks are awkward, heavy and difficult to carry in number, especially for the smaller children. Thus it is extremely common for the children to use standard backpacks comprising a relatively large containment compartment with a pair of shoulder straps, the compartment being positioned on the child's back with the child's arms inserted through the straps, which are positioned on the child's front. Unfortunately, this solution to the problem of transporting the books and notebooks presents problems of several sorts. The load is centralized in one area, putting a concentrated strain on the child's back in a manner which stresses the child's spine and can result in muscle fatigue or even injury to the child. This is exacerbated by the fact that the backpacks are usually not properly sized or fitted for the children, and are not designed to properly distribute the load in a manner such as found with expensive hiking and mountaineering backpacks, which have built-in, contoured stiffeners, cinch straps, waist belts, etc.

It is an object of this invention to provide a combination vest and backpack comprising a garment with large front and back pockets for receiving the load items, where the weight is evenly or more evenly distributed between the front and back of the wearer. Other garments or carrying devices to be worn are known in the prior art, but none are structured in a manner which accomplishes the goals of this invention. For example, U.S. Pat. No. 5,634,579 to Baclawski shows a backpack with an integral vest, where the front pocket is significantly smaller than the rear compartment. The garment is not joined at the sides in an extended manner, but instead is connected by straps only. U.S. Pat. No. 5,247,707 to Parker et al. shows a vest with an integral backpack and multiple small pockets distributed on the front. U.S. Pat. No. 5,195,187 to Yang shows a multi-pocketed vest with no backpack or large-volume rear pocket. U.S. Pat. No. 5,014,359 to Hanson shows a vest and backpack combination with a large number of small pockets. U.S. Pat. No. 5,002,270 to Shine shows an exercise vest with more pockets on the front than on the rear, where all the pockets are relatively small. U.S. Pat. No. 4,949,401 to Kimsey, Jr., shows a rear compartment mounted on a vest with small front pockets. U.S. Pat. No. 4,669,127 to Swanson shows a vest with a backpack and multiple small front pockets. U.S. Pat. No. 4,637,075 to Ingrisano et al. shows a vest with a number of small front pockets and a thin back pocket. None of these constructions would solve the problem encountered by school children where it is desirable to provide an even load distribution where the pockets are sized sufficiently large to accommodate school books and notebooks.

SUMMARY OF THE INVENTION

The invention is a pocketed vest or a combination vest and backpack garment for carrying school books, notebooks and other loads in a distributed manner such that the weight of the total load is relatively evenly proportioned relative to the front and back of the wearer, where the vest comprises a back body member joined to a pair of front body members, the front body members being releasably connectable, such that the combination of the back and front body members define a pair of arm openings, a neck opening and a waist opening. The body members are formed of fabric, vinyl or similar material which is flexible, strong and durable. The device is worn on the torso of a person by insertion of the arms through the arm openings, the neck being positioned in the neck opening, with subsequent connection of the two front body members across the front of the torso. A relatively large volume rear pocket or compartment is mounted onto the back body member and a relatively large volume front pocket is mounted onto each of the front body members, with the front pockets occupying the majority portion of the front body members. The rear pocket has top, bottom and side panels such that the pocket has a three-dimensional interior. The combined volume of the front pockets is preferably substantially equal to the volume of the rear pocket, and all pockets have large openings to allow large items to be received therein. Preferably the pockets are provided with closure means, such as a zipper, snaps, buttons, drawstrings, hook and pile fastener or other like means to temporarily close the pockets to better retain the items disposed internally.

DETAILED DESCRIPTION OF THE INVENTION

With reference to the drawings, the invention will now be described in detail with regard for the best mode and the preferred embodiment. In general, the invention comprises a pocketed vest or combination vest and backpack garment, appropriately sized to be worn by children to carry school books, note books and the like, where the load is substantially evenly distributed to the front and the rear of the vest such that excessive strain is not placed onto the back of the wearer. The vest and pockets may be composed of any suitable material having sufficient strength and flexibility, such as cloth fabric, synthetics, vinyls, mesh materials or the like.

Figure 1:
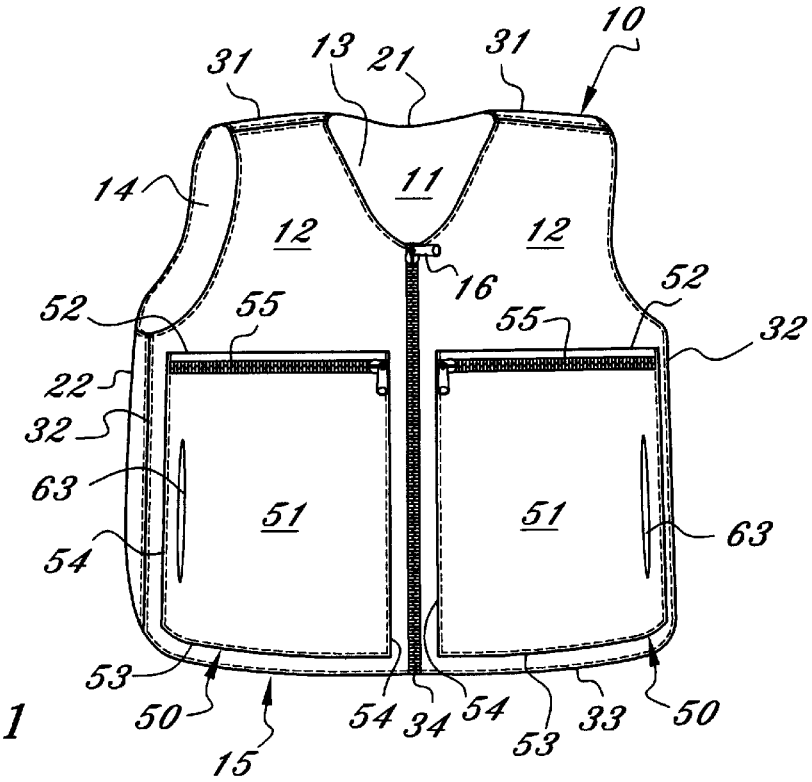
FIG. 1 is a perspective front view of the invention.
Figure 2:
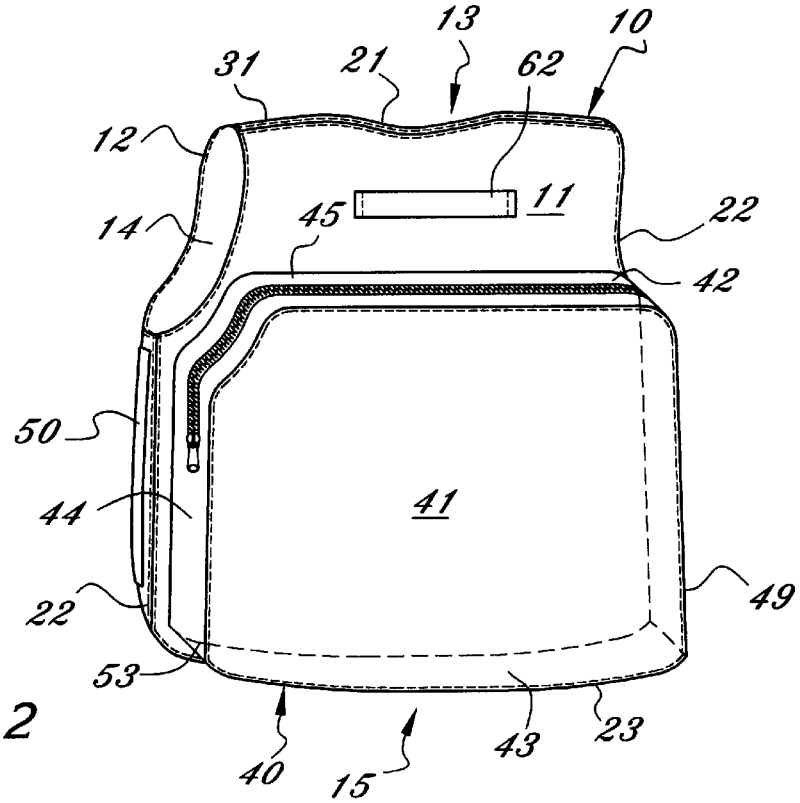
FIG. 2 is a perspective rear view of the invention.

As seen in FIGS. 1 and 2, the vest 10 comprises a back body member 11 having a top edge 21, a pair or lateral edges 22 and a bottom edge 23, and a pair of front body members 12 each having a top edge 31, a lateral edge 32, a bottom edge 33 and a free edge 34. The lower portion of the back body lateral edges 22 are connected to the lower portion of the front body lateral edges 32 by stitching or other suitable means, such that the free edges 34 of the front body members 12 are positioned to meet in the center of the front of the vest 10. The top edge 31 of one front body member 12 is joined to one side of the top edge 21 of the back body member 11 by stitching or other suitable means. Likewise, the top edge of the other front body member 12 is connected to the other side of the top edge 21 of the back body member 11. The center portion of the back body top edge 21 is preferably slightly scalloped or curved downward and the top portion of the front body free edges 34 are preferably recessed or curved in order to define a neck opening 13 to receive the wearer's neck and head. The top portion of the lateral edges 22 and 32 of front body members 12 and back body member 11 are preferably recessed or curved and not joined in order to define a pair of arm openings 14 to receive the wearer's arms therethrough. The combination of the bottom edges 23 and 33 of the front body members 12 and the back body member 11 define a waist opening 15 which surrounds the waist of the wearer when the vest 10 is disposed on the wearer's torso.

Front body closure means 16 are disposed on or adjacent the free edges 34 of the front body members 12 below the neck opening 13, such that the two front body members 12 can be releasably connected to each other in order to secure the vest about the torso of the wearer. Front body closure means 16 may comprise any suitable mechanism, such as for example a zipper, buttons, snaps, hook and pile type fasteners or the like.

A large volume back pocket 40 is mounted externally onto the back body member 11. The back pocket 40 comprises an outer panel 41, a top panel 42, a bottom panel 43 and a pair of opposing side panels 44, all connected to define an interior space within back pocket 40 to receive items to be carried. The top panel 42, bottom panel 43 and side panels 44 are connected to the back body member 11, causing outer panel 41 to be distended or disposed a distance away from the back body member 11, preferably in a generally parallel manner. Back pocket closure means 45 are provided to allow access into the interior of the back pocket 40, preferably within or along top panel 42 or in the upper portion of the outer panel 41, where the back pocket closure means 45 allow the back pocket 40 to be releasably sealed as desired to retain items within the back pocket 40. Back pocket closure means 45 may comprise any suitable mechanism, such as for example a zipper, buttons, snaps, hook and pile type fasteners or the like. Back pocket 40 covers the majority portion of back body member 11, extending vertically substantially from the bottom edge 23 defining the waist opening 15 to approximately the midpoint of the arm openings 14, and extending horizontally or laterally substantially from one back body lateral edge 22 to the other back body lateral edge 22. The top panel 42 of the back pocket 40 can be configured as a flap to enclose the upper portion of the outer panel 41.

Each of the front body members 12 is provided externally with a large volume front pocket 50. Front pockets 50, as shown in FIG. 1, each comprise an exterior panel 51 having a top edge 52, a bottom edge 53, and opposing side edges 54, where at least three of the top, bottom and side edges 52, 53 and 54 are connected to the front body member 12 by stitching or other suitable means. Where only three of the four edges 52, 53 and 54 are connected, preferably the top edge 52 remains unconnected to provide access to the interior of the front pocket 50. Preferably, closure means 55 are provided to releasably close the front pocket 50 and to provide access to the pocket interior. Front pocket closure means 55 may join either the top edge 52 or one of the side edges 53 to the front body member 50, or may be positioned in the upper or side portion of the exterior panel 52 itself. Closure means 55 may comprise any suitable mechanism, such as for example a zipper, buttons, snaps, hook and pile type fasteners or the like. Each front pocket 50 covers the majority portion of front body member 12, extending vertically substantially from the bottom edge 33 defining the waist opening 15 to approximately the bottom of the arm openings 14, extending horizontally or laterally substantially from the front body lateral edge 32 to the free edge 34. Each of the front pocket 50 is defined by a side opening 63 formed through the exterior panel 51 that is adjacent to the side edge 54 for supporting item placed within the pocket, as shown in FIG. 1.

Figure 3:
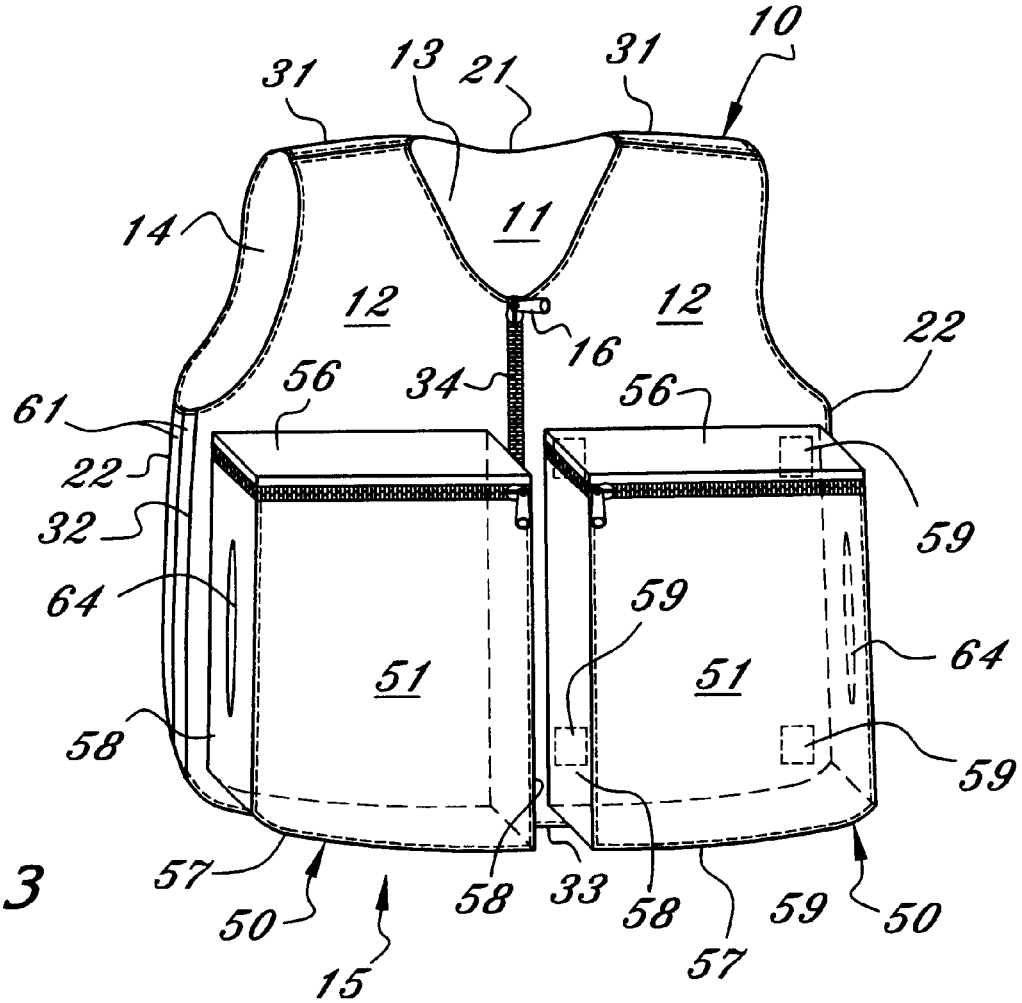
FIG. 3 is a perspective front view of an alternative embodiment of the invention.

Alternatively, as shown in FIG. 3, front pockets 50 may comprise an exterior panel 51, a top panel 56, a bottom panel 57 and a pair of opposing side panels 58, where the exterior panel 51 is joined to the top panel 56, bottom panel 57 and side panels 58, and where the top, bottom and side panels 58 are connected to the front body member 12 by stitching or other suitable means, such that the exterior panel 51 is distended and disposed in generally parallel and separated manner from the front body member 12 to define an interior for receiving items. Top panel or a side panel 58 is provided with closure means 55 to releasably close the front pocket 12. Alternatively, closure means 55 can be positioned on exterior panel 51 itself. The top panel 42 of the back pocket 40 can be configured as a flap to enclose the upper portion of the outer panel 41. As before, the font pockets 50 preferably cover the majority portion of front body member 12, extending vertically substantially from the bottom edge 33 defining the waist opening 15 to approximately the bottom of the arm openings 14, and extending horizontally or laterally substantially from the front body lateral edge 32 to the free edge 34. Preferably in this configuration, the total volume of the two front pockets 50 is substantially near or equal to the volume of the back pocket 40. Each of the front pocket 50 is defined by a side opening 64 formed through the side panel 58 that are adjacent to the side lateral edges 32 for supporting items placed within the pocket, as shown in FIG. 3. Also as shown in FIG. 3, the vest 10 may be provided with a paid of elastic panels 61 which are used to join the lateral edges 22 of the back body member 11 to the lateral edges 32 of the front body members 12. This allows the vest 10 to better adapt to different torso sizes. A carry strap or handle 62, as seen in FIG. 2, can be provided across the middle of back body member 11 to provide an efficient and comfortable way to carry the vest 10 when it is not being worn. In addition, the front pockets 50 can be detachable joined to the front body members 12 by attachment means 59, such as through the use of hook and pile type fasteners, thereby allowing the individual front pockets 40 to be removed if desired.

It is understood and contemplated that equivalents and substitutions may be obvious and apparent to those skilled in the art for certain elements set forth above, and the true scope and definition of the invention therefore is to be set forth in the claims below.

We claim:

1. A vest for carrying school books, note books and other loads in a distributed manner such that the weight of the load is substantially evenly proportioned between the front of the wearer and the back of the wearer, said vest comprising a back body member having a top edge and lateral edges, two front body members each having a top edge, a lateral edge and a free edge, where said back body member and said front body members are joined along said top edges and said lateral edges, front body closure means to releasably join said free edges of said front body members to each other, where said back body member and said front body members in combination define a neck opening to receive the wearer's neck and head, two arm openings to receive the wearer's arms, said arm openings having a bottom and a midpoint, and a waist opening to receive the wearer's waist;

a large volume back pocket mounted onto said back body member and comprising an outer panel, a top panel, a bottom panel and two opposing side panels, where said outer panel is joined to said back body member by said top, bottom and side panels such that said outer panel is disposed in a generally parallel manner a distance from said back body member to define an interior, where said top panel further comprises back pocket closure means to provide access to said interior of said back pocket, said back pocket covering a majority portion of said back body member and extending vertically substantially from said waist opening to approximately the midpoint of said arm openings and extending horizontally substantially from one said lateral edge of said back body member to the other said lateral edge of said back body member;

two large volume front pockets, one of said front pockets mounted onto each of said front body members, each front pocket comprising an exterior panel having a bottom edge, opposing side edges and a top edge, where said bottom and side edges are connected to said front body member, and front pocket closure means to releasably connect said top edge to said front body member and extending vertically substantially from said waist opening to the bottom of said arm openings and extending horizontally substantially from said lateral edge of said front body member to said free edge of said front panel member; wherein a side opening is formed through the exterior panel adjacent to the side edge for supporting loads placed within the front pockets.

2. The vest of claim 1, where at least one of the said front body closure means, back pocket closure means and front pocket closure means comprises a zipper.

3. The vest of claim 1, where at least one of the said front body closure means, back pocket closure means and front pocket closure means comprises a hook and pile type fastener.

4. The vest of claim 1, where at least one of the said front body closure means, back pocket closure means and front pocket closure means comprises buttons.

5. The vest of claim 1, where at least one of the said front body closure means, back pocket closure means and front pocket closure means comprises a drawstring.

6. The vest of claim 1, where at least one of the said front body closure means, back pocket closure means and front pocket closure means comprises snaps.

7. The vest of claim 1, where said lateral edges of said back body member are joined to said lateral edges of said front body members by elastic panels.

8. The vest of claim 7, further comprising hook and loop type fasteners joining said front pockets to said front body member.

9. The vest of claim 8, where the total volume of said two front pockets is equal to the volume of said back pocket.

10. The vest of claim 8, where at least one of said front body closure means, back pocket closure means and front pocket closure means comprises a zipper.

11. The vest of claim 8, where at least one of said front body closure means, back pocket closure means and front pocket closure means comprises a hook and pile type fastener.

12. The vest of claim 8, where at least one of said front body closure means, back pocket closure means and front pocket closure means comprises buttons.

13. The vest of claim 8, where at least one of said front body closure means, back pocket closure means and front pocket closure means comprises a drawstring.

14. The vest of claim 8, where at least one of said front body closure means, back pocket closure means and front pocket closure means comprises snaps.

15. The vest of claim 8, where said lateral edges of said back body member are joined to said lateral edges of said front body members by elastic panels.

16. The vest of claim 8, where said front pockets are detachable from said front body member.

17. The vest of claim 8, further comprising hook and loop type fasteners joining said front pockets to said front body member.

18. The vest of claim 1, where said front pockets are detachable from said front body member.

19. A vest for carrying school books, note books and other loads in a distributed manner such that the weight of the load is substantially evenly proportioned between the front of the wearer and the back of the wearer, said vest comprising a back body member having a top edge and lateral edges, two front body members each having a top edge, a lateral edge and a free edge, where said back body member and said front body members are joined along said top edges and said lateral edges, front body closure means to releasably join said free edges of said front body members to each other, where said back body member and said front body members in combination define a neck opening to receive the wearer's neck and head, two arm openings to receive the wearer's arms, said arm openings having a bottom and a midpoint, and a waist opening to receive the wearer's waist:

a large volume back pocket mounted onto said back body member and comprising an outer panel, a top panel, a bottom panel and two opposing side panels, where said outer panel is joined to said back body member by said top, bottom and side panels such that said outer panel is disposed in a generally parallel manner a distance from said back body member, where said top panel further comprises back pocket closure means to provide access to the interior of said top panel further comprises back pocket closure means to provide access to the interior of said back pocket, said back pocket covering a majority portion of said back body member and extending vertically substantially from said waist opening to approximately the midpoint of said arm openings and extending horizontally substantially from one said lateral edge of said back body member to the other said lateral edge of said back body member;

two large volume front pockets, one of said front pockets mounted onto each of said front body members, each front pocket comprising and exterior panel, a top panel, a bottom panel and two opposing side panels, where said exterior panel is joined to said front body member by said front pocket top, bottom and side front panels such that said exterior panel is separated from and disposed in generally parallel manner a distance from said front body member to define an interior, and front pocket closure means to provide access to said interior, said front pocket covering a majority portion of said front body member and extending vertically substantially from said lateral edge of said front body member to said free edge of said front body member; wherein a side opening is formed through the side panels adjacent to the side edge for supporting loads placed within the front pockets.

* * * * *